United States Patent [19]

Baba

[11] Patent Number: 4,898,045

[45] Date of Patent: Feb. 6, 1990

[54] CONTROL DEVICE FOR BOAT ENGINE

[75] Inventor: Masanao Baba, Takarazuka, Japan

[73] Assignee: Nippon Cable System Inc., Takarazuka, Japan

[21] Appl. No.: 192,032

[22] Filed: May 9, 1988

[30] Foreign Application Priority Data

Nov. 20, 1987 [JP] Japan ..... 62-294808

[51] Int. Cl.[4] ..... B63H 21/24

[52] U.S. Cl. ..... 74/471 R; 74/473 R; 192/0.096

[58] Field of Search ..... 74/471 R, 473 R, 877, 74/879; 192/0.096

[56] References Cited

U.S. PATENT DOCUMENTS

| | | | |
|---|---|---|---|
| 2,957,352 | 10/1960 | Pierce | 74/471 |
| 3,083,587 | 4/1963 | Buddo | 74/471 |
| 3,127,785 | 4/1964 | Morse et al. | 192/0.096 |
| 4,034,835 | 7/1977 | Baba | 192/98 |
| 4,470,492 | 9/1984 | Kobelt | 192/0.096 |
| 4,632,232 | 12/1986 | Kolb et al. | 192/0.096 |

FOREIGN PATENT DOCUMENTS 54-9796 2/1976 Japan .

*Primary Examiner*—Leslie A. Braun
*Assistant Examiner*—Scott Anchell
*Attorney, Agent, or Firm*—Armstrong, Nikaido, Marmelstein, Kubovcik & Murray

[57] ABSTRACT

A control device for a boat engine, capable of controlling both clutch and throttle with a single lever. The control device has a supporting shaft installed within a housing. A clutch arm, an operating disk and a throttle arm are rotatably mounted on the supporting shaft in such order. The root portion of the operating lever radially extending through a slit of a peripheral portion of the housing is fixed to the periphery of the operating disk. The control device has a gear mechanism and a cam-link mechanism. The gear mechanism changes the first stage turning of the operating disk to a swing movement of the clutch arm, and then, locks the clutch arm after the clutch arm has been swung to an end position. The cam-link mechanism prevents swing movement of the throttle arm during the first turning stage of the operating disk and also provides a swing movement of the throttle arm during the latter turning stage of the operating disk.

3 Claims, 9 Drawing Sheets

8
W
H
7
12
55
III
II
1
5
15
21
2
14
29
13
I
N
100
4
3
35
6
31
42
5
5b
III
II
27
28

14
24
24
13
21
14
24
16
17
19
15
18
26
3
6
8
5
23
22
20
25
25
20
31
4
37
1
15a
40
36
35
42

FIG. 10
(PRIOR ART)
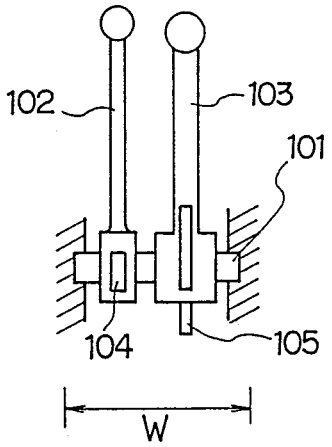
FIG. 11
(PRIOR ART)
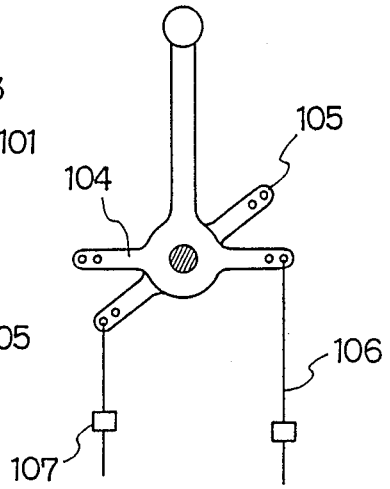
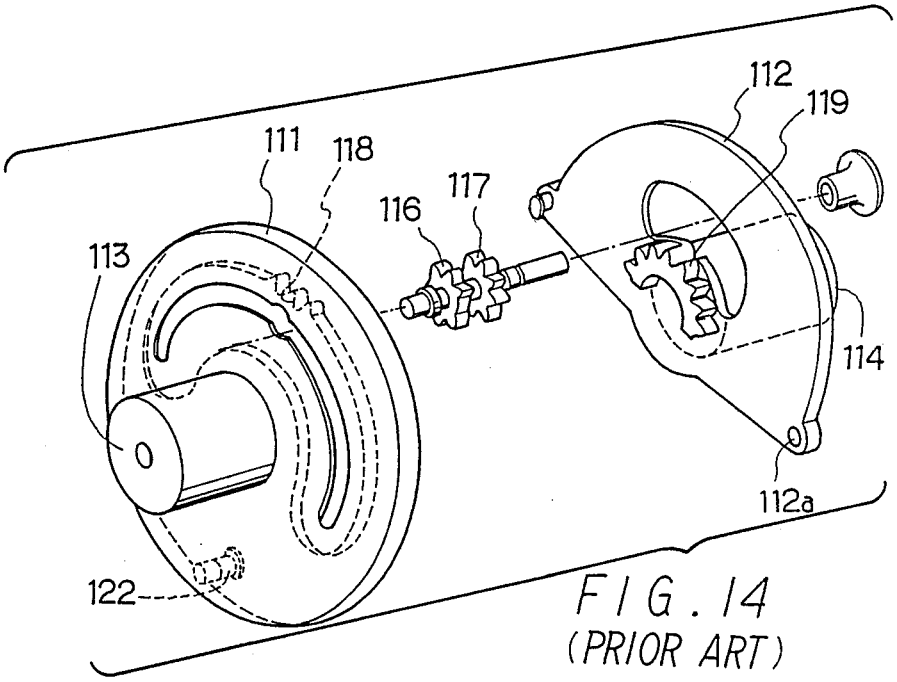
FIG. 14
(PRIOR ART)

CONTROL DEVICE FOR BOAT ENGINE

BACKGROUND OF THE INVENTION

The present invention relates to a control device for a boat engine, and more particularly, to a device for controlling both clutch and throttle of the boat engine with a single lever.

In a general boat, in order to effectively utilize a space in the boat, a passage or passages leading to a front part of the boat are provided on both sides of a operator's seat or on the center of a operator's cab. In order to secure the passage spaces, a dashboard with narrower width is suitably employed. Since a number of meters and switches are mounted on the dashboard, it is strongly demanded to reduce the width of the engine control device to be mounted on the dashboard.

Moreover, push-pull control cables for operating a clutch and a throttle (hereinafter, referred to as "clutch cable" and "throttle cable") extend downwardly from the bottom of the control device. If bending radii of the control cables are small, required operating force becomes larger and the control cables tend to be easily damaged. Therefore, the height of the control device is also required to be shortened.

By the way, there has been known a conventional control device for a boat engine, having two operating levers as shown in FIG. 10 and FIG. 11. In the device, two operating levers 102 and 103 are supported on a single shaft 101, and a clutch arm 104 and a throttle arm 105 are connected to the operating levers 102 and the operating lever 103, respectively. Further a clutch cable 106 and a throttle cable 107 are connected to the clutch arm 104 and the throttle arm 105, respectively.

However, since the two levers 102, 103 are arranged in a line on the single shaft 101 in the above device, the width W of the device becomes thick.

Therefore, another device having a single lever for controlling both clutch and throttle is proposed (for example, see Japanese examined patent model publication No. 9796/1979).

The above-mentioned device, as shown in FIGS. 12 to 14, comprises a disk 111 for operating a throttle cable and a half discal plate 112 for operating a clutch cable. Each shaft 113, 114 of the disk 111 and the plate 112 are rotatably supported on a housing 115. An operating lever 110 is fixed to an end of the shaft 113 and is arranged at the side of the housing 115. A set of inward teeth 118 engaging with a pinion 116 is formed on a side surface of the operating disk 111, and a set of outward teeth engaging with another pinion 117 is formed on a side surface of the operating plate 112. By means of the gear mechanisms (two sets of teeth 118, 119 and pinions 116, 117), rotation of the operating disk 111 can be transmitted to the operating plate 112 through the pinions 116 and 117.

A clutch cable 120 is connected to a lateral side end of the operating plate 112 by utilizing a hole 112*a*, and a throttle cable 121 is connected to a pin 122 fixed to the lower end of the operating disk 111. When the operating lever 110 is moved in the direction of arrow A or B, the clutch cable 120 is moved in the direction of arrow F or R to provide change of modes, i.e. between a forward mode and a reverse mode. When the operating lever 110 is further moved in the same direction, the throttle cable 121 is moved in the direction of arrow D or E, i.e. to the right side position (shown by imaginary line) or to the left side position (not shown) from the center position (shown by real line) of the disk 111.

In the above-mentioned device, in either case that the operating lever 110 is moved in the direction of arrow A or in the direction of arrow B, the throttle cable 121 must be moved in the same direction (upward) with the same stroke. Therefore, the end of the throttle cable 121 is connected on the center and lower end of the operating disk 111.

In the above-mentioned conventional device, since the operating lever 110 is fixed to the end of the shaft 113 and is positioned at the lateral side of the housing 115, the device is thick. Moreover, since the throttle cable 121 is connected at the center and lower end of the operating disk 111 and extends dawnwardly from the lower end of the operating disk 111, the height of the device is large. Further, when the lever 110 is operated, the throttle cable 121 is shaken in the direction of arrow S with small carvature radius as shown in FIG. 13. Therefore, the cable is damaged by repetitive flex, especially in a boat having a narrow lower space. Further, since the shaft 113 must be positioned upper than the dashboard 100 to rotate the operating lever 110 freely, the height of the portion projecting from the dashboard is large.

As mentioned above, the conventional device either having two levers or one lever has defects that the size of the device is large and the cable tends to be easily damaged.

The object of the present invention is to provide a control device in which width and height are small, height of the portion projecting from the dashboard is also small, and the cable is not easily damaged.

SUMMARY OF THE INVENTION

In accordance with the present invention, there is provided a control device for a boat engine, comprising a clutch arm, an operating disk, a throttle arm and a single shaft for rotatably supporting the clutch arm, the operating disk and the throttle arm in this order. The device further comprises an operating lever radially and outwardly extending from the periphery of the operating disk for turnning the operating disk, a gear mechanism installed between the operating disk and the clutch arm to change the first turn stage of the operating disk into the swing movement of the clutch arm and a cam-link mechanism installed between the operating disk and the throttle arm to change the latter turn stage of the operating disk into the swing movement of the throttle arm.

In the device of the present invention, the operating disk is generally turned in the range of less than a half turn. The term "first turn stage" in claims means a turning range from the neutral position to a halfway not reaching to the stroke end, in both rotational directions, and the term "latter turn stage" in claims means the turning range from the end of the first turn stage to the stroke end, in both rotational directions.

In the device of the present invention, since the operating lever is directly connected to the outer periphery of the operating disk and is not connected to the end of the supporting shaft, thickness of the device can be reduced.

Further, since the operating lever is not fixed to the shaft end, the shaft can be provided under the dashboard. Therefore, the height of the portion projecting from the dashboard can be reduced.

The clutch arm and the throttle arm are supported concentrically on the supporting shaft so that the arms horizontally extend from the supporting shaft when the arms are in the rest position. Therefore, the ends of the arms can be swung almost vertically. As a result, the cables connected to the lateral ends of the arms receive only push or pull movement in the vertical direction and do not receive shake movement. Therefore, both conduits of the cables can be fixed in stationary states at the lower portion of the device. Accordingly, excessive space under the device is not required, and the cables can be prevented from the damage.

The device of the present invention and the functions thereof can be more sufficiently understood from the following descriptions as to some embodiments with the accompanying drawings.

BRIEF DESCRIPTION OF THE DRAWINGS

FIG. 10 and FIG. 11 are a side view and a front view showing a conventional device, respectively; and FIGS. 12 to 14 are a sectional view, a front sectional view and an exploded perspective view, respectively, of an example of a conventional device with a single lever.

DETAILED DESCRIPTION

Figure 1:
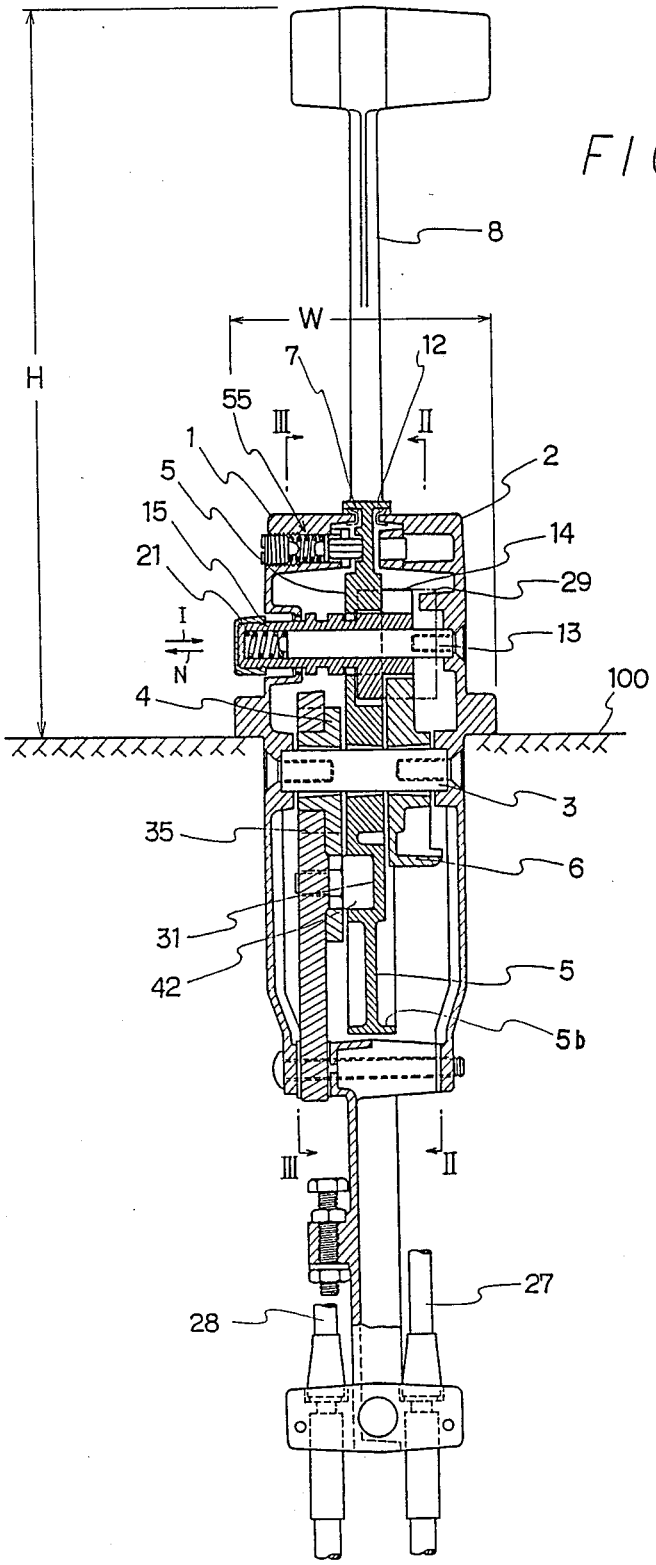
FIG. 1 is a sectional view showing a first embodiment of the device of the present invention.

FIG. 1 shows a whole structure of a first embodiment of the control device of the present invention by way of a sectional view taken along the longitudinal direction of the supporting shaft. Numerals 1 and 2 show two halves of a housing, respectively. Each upper portion of the housing 1, 2 is formed into a half cylindrical shape, and each lower portion like a column of the housing 1,2 extends downwardly.

A supporting shaft 3 is installed between the housing 1 and the housing 2. A clutch arm 6, an operating disk 5 and a throttle arm 4 are rotatably mounted on the supporting shaft 3 through bushs in such order from right side to left side, as shown in FIG. 1.

The operating disk 5 is a disk-like member having a rim 5*b* around its periphery. An operating lever 8 extends in the approximately upward direction (in the rest state) from the upper portion of the periphery of the operating disk 5, and passes through a slit 7 formed between the housings 1 and 2. The numeral 12 designates a waterproof seal installed on the inside edge of the housing 1,2.

A pin 13 is installed inside the housing 1,2 at a position over the supporting shaft 3 by fixing the right end of the pin 13 to the housing 2. A pinion 14 is mounted on the pin 13.

A detent mechanism 55 is installed between the housing 1 and the operating disk 5, at a position over the pin 13.

Next, a clutch operating unit is described hereinafter, referring to FIG. 1 and FIG. 4.

The clutch operating unit comprises a following gear mechanism. The above-mentioned pinion 14 can be slided and rotated around the pin 13. The pinion 14 has a long-cup-like boss 15 extending in the axial direction and being integrally formed as one body, and the boss 15 has a hollow space. A spring 21 is inserted between a bottom of the boss 15 and a top end of the pin 13 so that the pinion 14 is usually urged to be pulled toward the operating disk 5. A root portion 19 of the boss 15 has a larger diameter than that of the free end portion thereof, and two annular grooves 18 are formed in the outer surface of the root portion 19. A cap 15*a* is fixed on the end of the boss 15 which projects from the housing 1.

The pinion 14 has a first portion 16 and a second portion 17 which are axially arranged. The first portion 16 is a right side portion with all teeth, and the second portion 17 is a left side portion without two teeth as shown in FIGS. 4 and 4A. The tooth-lacking portions 24 are arranged symmetrically with respect to the axis of the pinion 16.

On the other hand, a slit 20 is formed in the operating disk 15. The slit 20 has an inner peripheral edge capable of fitting with the annular grooves 18 of the boss 15. The slit 20 is formed as an arc shape having a common center with the supporting shaft 3 in order to allow the rotation of the operating disk 5. At the center portion of the slit 20, an enlarged circular hole 22 is formed to pass the middle annular portion between the two grooves 18 of the root portion 19. Therefore, when the operating disk 15 is positioned at the neutral position, the pinion 14 can be moved toward the housing 2 (shown in FIG. 1 by an imaginary line) by depressing the cap 15*a*. In the housing 2, a stopper 29 having inward teeth capable of engaging with the teeth of the pinion 14 is formed.

When the pinion 14 is pushed in the direction of the arrow I as shown in FIG. 1, the first portion 16 of the pinion is engaged with the stopper 29 to stop free rotation of the pinion 14. On the outside of the hole 22 of the operating disk 5, a set of inward teeth 23 which can engage with the teeth of the pinion 14 is provided. On the outside of the slit 20 of the operating disk 5, an arc-shaped rib 25 is provided. The inner surface of the rib 25 is a guide to be in contact with both teeth adjacent to the tooth-lacking portion 24 of the second portion 17 of the pinion 14, in order not to rotate the pinion 14 when the operating disk 5 is rotated.

On a boss of the above-mentioned clutch arm 6, a set of outward teeth 26 engageable with the first portion 16 of the pinion 14 is provided. Further, a clutch cable 27 is connected to an end of the clutch arm 6.

Next, operation of the above-mentioned clutch unit is described hereinafter, referring to FIG. 2.

Figure 2:
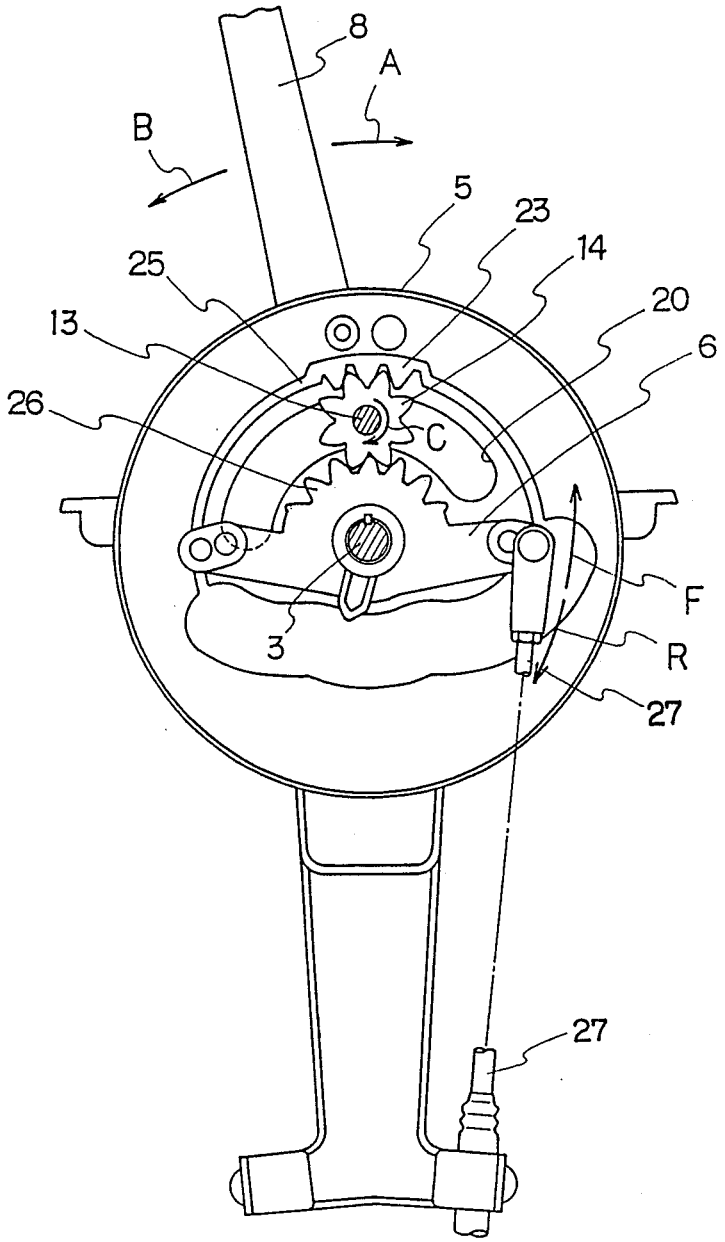
FIG. 2 and FIG. 3 are a sectional view taken along the line (II)—(II) and a sectional view taken along the line (III)—(III) in FIG. 1, respectively.

FIG. 2 shows a neutral state of the unit, and the clutch is also positioned at a "neutral" position. In condition that the boss 15 is not depressed (as shown in FIG. 1), a normal control operation can be performed as mentioned below.

When the operating lever 8 is moved in the direction of arrow A as shown in FIG. 2, the operating disk 5 is also turned in the same direction. Therefore, due to the engagement between the set of inward teeth 23 and the second portion 17, the pinion 14 is rotated in the direction of arrow C. Consequently, the clutch arm 6 turns in the direction of arrow F due to the engagement between the outward teeth 26 of the clutch arm 6 and the first portion 16 of the pinion 14 so as to provide the changing operation of the clutch to "ahead (forward)" position.

In addition, when the operating lever 8 is further moved in the same direction, the tooth-lacking portion 24 of the first portion 16 of the pinion 14 comes to contact with and slides on the inner surface of the rib 25 to prevent the pinion 14 from rotation. Therefore, since the pinion 14 is locked at the preset turning angle, even if the operating lever 3 is turned, the clutch arm 6 cannot be turned and keeps the clutch in the ahead (forward) condition.

When the operating lever 8 is moved in the direction of arrow B from the above-mentioned condition, the teeth of the second portion 17 come to engage with the inward teeth 23. Then, since the above engagement allows the pinion 14 to rotate, the clutch arm 6 is moved in the direction of arrow R and the clutch is returned to the neutral position.

In case that the operating lever 8 is moved in the direction of arrow B from the neutral position, another tooth-lacking portion 24 is moved in contact with the inner peripheral surface of the rib 25 and the above-mentioned mechanism is moved in the reverse direction to select the clutch to the "astern (reverse)" position. However, the movement itself of above mechanism is substantially the same as the above-mentioned ahead operation.

Next, an idling operation is described hereinafter.

In the condition that the operating lever 8 is positioned at the neutral position, when the boss 15 is pushed in the direction of arrow I as shown in FIG. 1, the boss 15 passes through the hole 22 to shift the pinion 14 in the same direction. As a result, the first portion 16 of the pinion 14 is engaged with the stopper 29 and the second portion 17 of the pinion 14 is engaged with the set of outward teeth 26 of the clutch arm 6.

In the above mentioned-condition, the clutch arm 6 is locked, but the operating disk 5 can be freely rotated. Further, after the operating disk 5 has been turned in order to operate the throttle, as described after, for idling operation of the engine starts, the pinion 14 will not be return in the direction of arrow N even if the operator removes his finger from the end of the boss 15, since the annular groove 18 engages with the peripheral back surface of the slit 20. As a result, the idling operation can be smoothly carried out. However, when the operating lever 8 is returned to the neutral position, the pinion 14 is naturally returned in the direction of arrow N by a force of the spring 21, since the root portion 19 of the boss 15 can be passed through the hole 22 again. As a result, the device can be controlled in normal control version.

Figure 3:
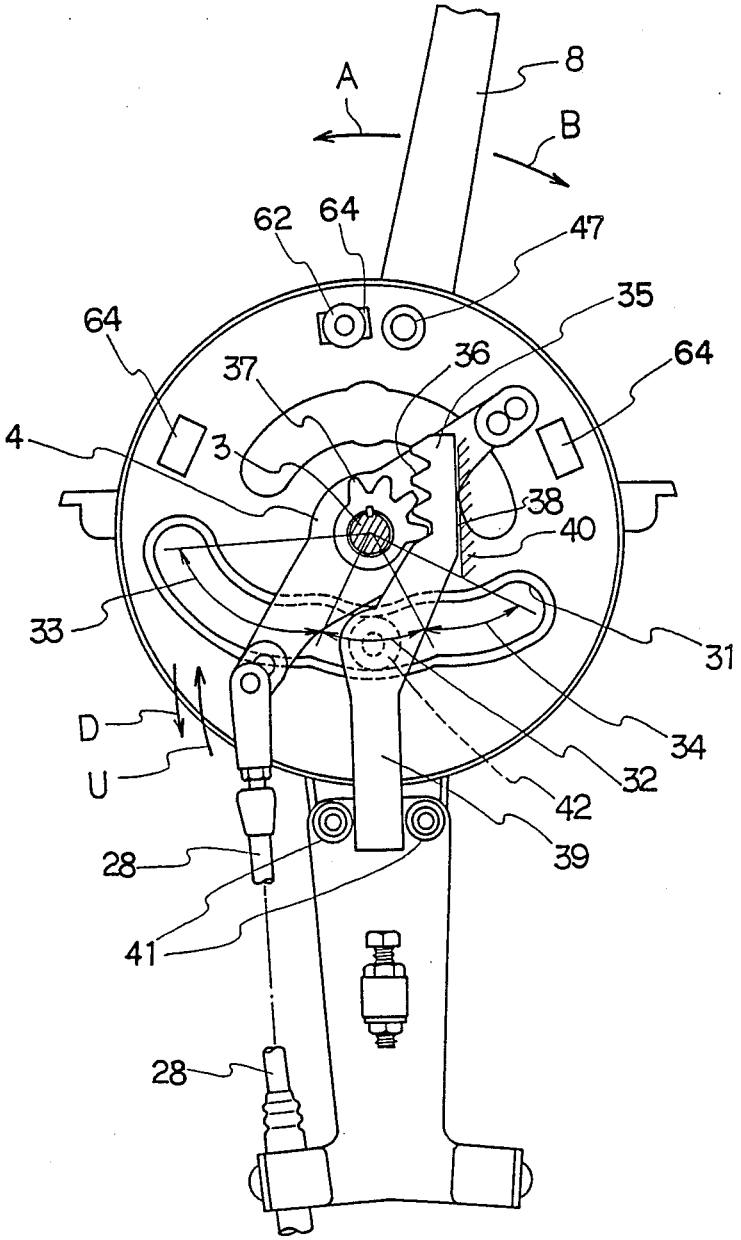
Figures 4, 4A:
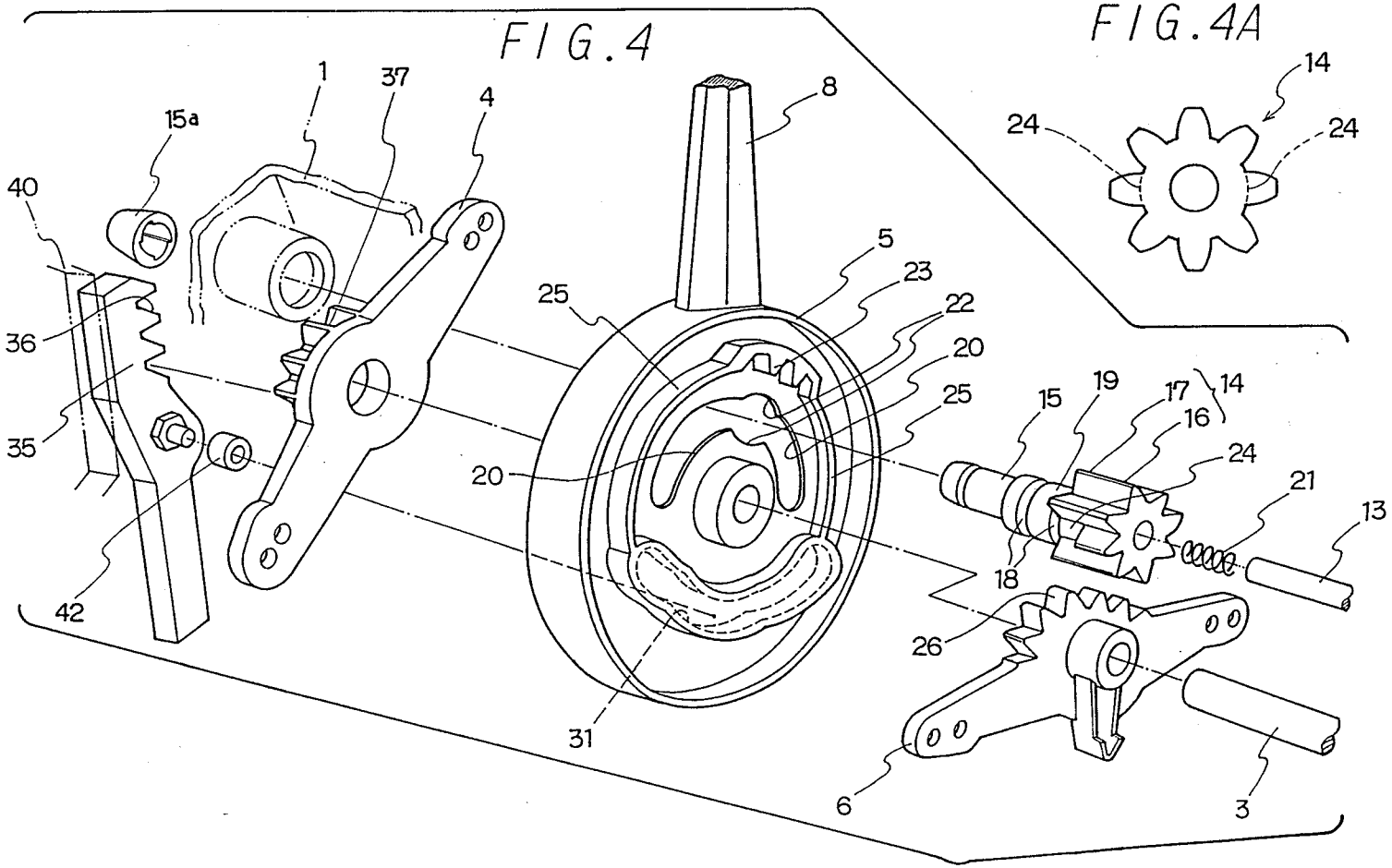
FIG. 4 is an exploded perspective view of a main portion of the device shown in FIGS. 1 to 3.
FIG. 4A is a front view of a pinion used in the device of FIG. 1.

Next, referring to FIGS. 3 and 4, a throttle operating unit is described.

The throttle operating unit comprises a camlink mechanism as mentioned below. A cam groove 31 is formed in a lower portion of one side surface of the operating disk 5 (as shown in reverse side with broken line in FIG. 4). The cam groove 31 has a center area 32 corresponding to a clutch-operating range, an ahead area 33 and an astern area 34.

The center area 32 is an arc-shaped cam groove with a constant radius with respect to the rotational axis, i.e. the supporting shaft 3. The ahead area 33 and the astern area 34 are also arc-shaped cam-grooves, respectively. However, the cam-grooves in the areas 33 and 34 are eccentric with respect to the rotational axis. Further, the radius of each area in the outside-end-portion thereof is larger than that of the inside-end-portion.

A rack member 35 is accommodated in a space between the operating disk 5 and the housing 1. A set of rack teeth 36 is formed on an upper-inside portion of the rack member 35 so as to be engaged with a set of teeth 37 which is formed on an outer surface of a boss of the throttle arm 4. The rack member 35 has a linear or flat back side surface 38, and the surface 38 is guided with a linear guide 40 attached to the housing 1. The rack member 35 further has a lower linear portion 39 to be guided with two guide rollers 41 rotatably mounted on a lower portion of the housing 1. Therefore, the rack member 35 can be moved only in the vertical direction.

Further, a roller-follower or cam-follower 42 is rotatably installed on a middle portion of the rack member 35, and the cam-follower 42 is inserted in the above-mentioned cam groove 31 of the operating disk 5.

The throttle cable (push-pull control cable) 28 for operating the throttle is connected to a free end of the throttle arm 4.

Next, referring to FIG. 3, operation of the above-mentioned throttle unit is described.

First, a case where the operating lever 8 is moved in the direction of arrow A from the neutral position is described.

On condition that the cam-follower 42 is positioned within the center area 32 of the cam groove 31, even if the operating lever 8 is moved in the direction of arrow A, the rack member 35 will not be moved.

When the operating lever 8 is further moved in the same direction to push the cam-follower 42 into the ahead area 33, the cam-follower 42 becomes to be pushed down in proportion to the turn of the operating disk 5, so as to pull down the rack member 35. When the rack member 35 is pulled down, the throttle arm 4 is moved in the direction of arrow U due to the engagement between the rack teeth 36 and the teeth 37. As a result, the throttle valve is opened to accelerate the engine. When the operating lever 8 is moved in the reverse direction from the full-throttle position to the center area 32, the rack member 35 is pushed up to rotate the throttle arm 4 in the direction of arrow D. As a result, the throttle valve is throttled to decelerate the engine.

When the operating lever 8 is moved in the direction of arrow B from the neutral position, the astern area 34 moves the cam-follower 42 downwardly or upwardly and the throttle arm 4 is rotated as the same manner as the above-mentioned operation to accelerate or decelerate the engine speed.

Next, a brake apparatus 46 and a detent mechanism 55 of the operating disk 5 is described.

Figure 5:
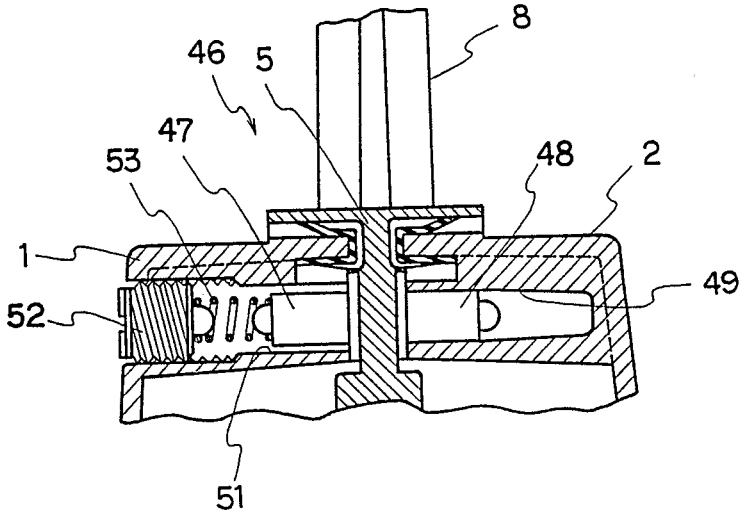
FIG. 5 is a sectional view showing an embodiment of a brake apparatus in the present invention.

FIG. 5 shows the brake apparatus 46. A brake pad 47, shown in the left hand side of the drawing, is inserted into a hole 51 formed in the housing 1. The brake pad 47 is urged against the operating disk 5 by a spring 53 installed in the hole 51 and held by a set screw screwed into the hole 51. A counter brake pad 48 shown in right hand side of the drawing is attached in a hole 49 formed in the housing 2 in order to support a brake load applied by the spring 53.

When the set screw 52 is loosened, the friction between the brake pad 47 and the operating disk 5 is reduced, and when the set screw 52 is tightened, the friction is increased. By virtue of the brake apparatus 46, free rotation of the operating disk 5 is prevented and a good feel can be obtained since a suitable force is required for operating the operating lever 8.

Figure 6:
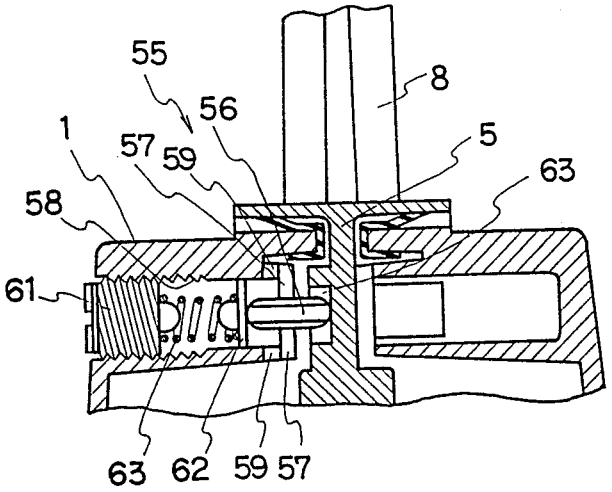
FIG. 6 is a sectional view showing an embodiment of a detent mechanism in the present invention.

FIG. 6 shows the detent mechanism 55. The numeral 56 denotes a roller. A shaft 57 of the roller 56 is inserted into a U-shaped groove 59 formed in the inside-end of a hole 58. A spring 63 is inserted between a set screw 61 and a catch plate 62 adjacent to the roller 56. The roller 56 is usually urged against the operating disk 5 by the spring 63. As shown in FIG. 3, three recessed portions 64 are formed in the side face of the operating disk 5. When the operating disk 5 is moved to the neutral position or full stroke positions, the roller 56 is entered into the recessed portions 64. Then, the operating disk 5 is held in the required positions.

Figure 12:
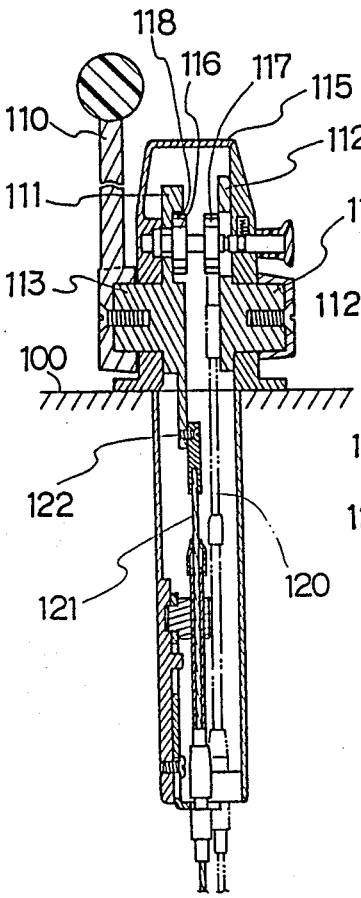
FIG. 12 (PRIOR ART)
Figure 13:
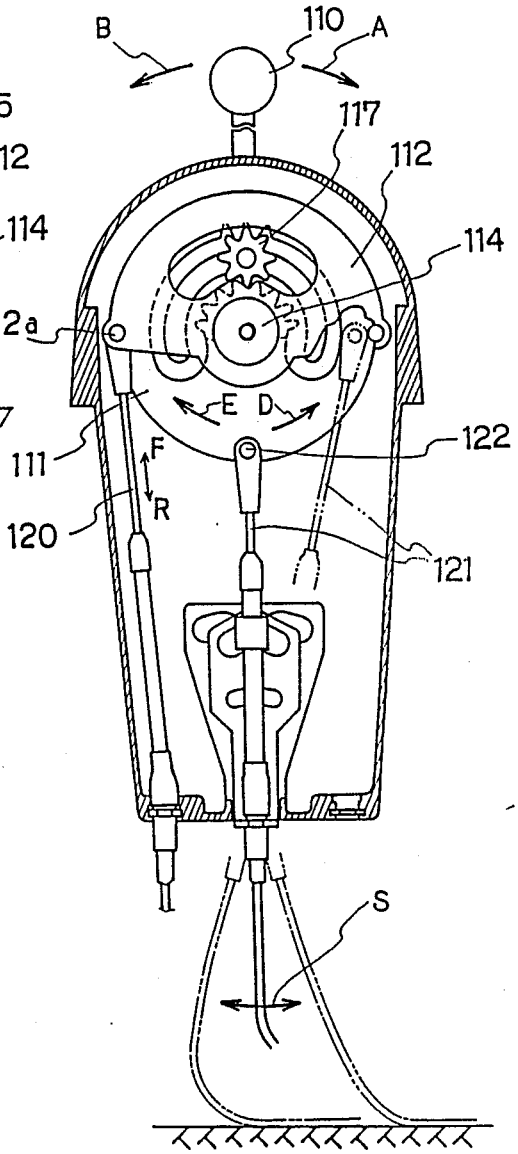
FIG. 13 (PRIOR ART)

As mentioned above, the control device of the present invention has an advantage that the device can be made smaller. As shown in FIG. 1, the operating lever 8 extends upwardly from the periphery of the operating disk 5. Therefore, the width W on the control device is tolerably reduced when compared with the width of a conventional device which has an operating lever 110 fixed on the end of the shaft 113 (see FIG. 12). Further, since a space for allowing the turn of the boss of the operating lever 8 is not required, the supporting shaft 3 can be located in a position lower than the dashboard surface or installation surface 100. Therefore, the height H of the part projecting from the installation surface 100 is reduced. Further, since the control cables 27, 28 are directly pushed or pulled only in the vertical directions, they are not swung below the device. Therefore, the control cables are not damaged. And since the control cables 27, 28 are supported by the arms 4,6 at almost lateral sides of the supporting shaft 3, i.e. not at the bottom end, the whole height of the device can be also reduced.

Figure 7:
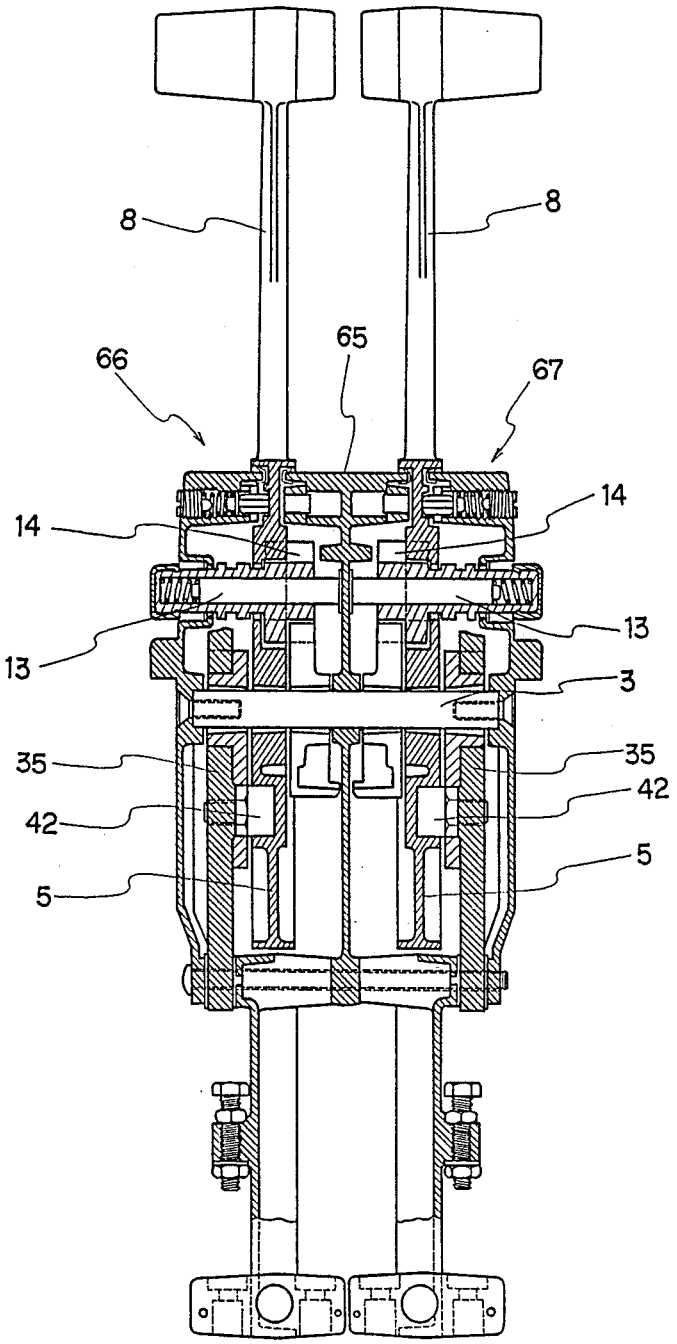
FIG. 7 is a sectional view showing a second embodiment of the device of the present invention.

A second embodiment of the device of the present invention is shown in FIG. 7. The device of the second embodiment is made by combining two devices of the first embodiment with each other. The device is used for controlling a boat which has two engines, and the device has a large housing 65 so as to accommodate two devices 66, 67. Each device 66, 67 has substantially the same structure as the device of the first embodiment. In FIG. 7, reference numbers of the major parts are the same as the device of the first embodiment.

Figures 8, 9:
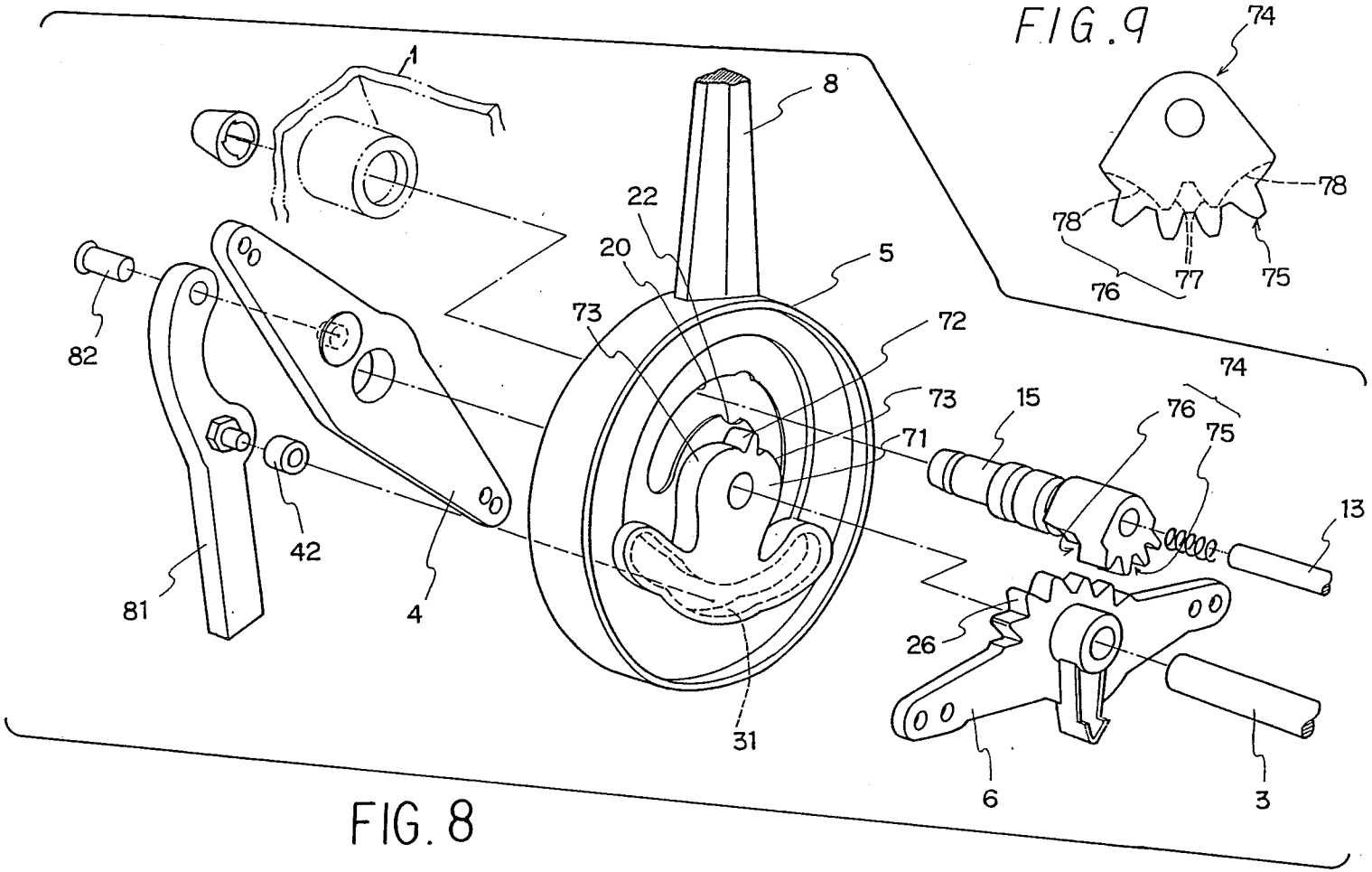
FIG. 8 is an exploded perspective view of a third embodiment of the device of the present invention.
FIG. 9 is a front view showing a sector gear shown in FIG. 8.

Referring to FIGS. 8 and 9, a third embodiment of the device of the present invention is described hereinafter. The device has the same structure as the device of the first embodiment except a gear mechanism of the clutch operating unit and a cam-link mechanism of the throttle operating unit. Therefore, only the clutch operating unit and the throttle operting unit are described hereinafter.

In FIGS. 8 and 9, the same parts as the first embodiment are marked with the same reference numbers of the first embodiment.

The gear mechanism of the clutch operating unit has a construction as mentioned below. On a boss 71 of an operating disk 5, a single tooth 72 is formed at the position just below an enlarged circular hole 22 of a slit 20. On either sides of the tooth 72, the boss 71 is provided with a guide surface or slide surface 73. A sector gear 74 is mounted on a pin 13 in rotatable and axially slidable manner. The sector gear 74 has a first portion 75 with four teeth and a second portion 76 with two teeth 77.

Both side portions of the two teeth 77 of the second portion 76 are arc-shaped slide surfaces 78 capable of sliding on the slide surface 73 of the boss 71, as shown in FIG. 9.

According to the above-mentioned structure, the first rotation stage of the operating disk 5 causes a rotation of the sector gear 74 due to the engagement between the single tooth 72 of the boss 71 and the teeth 77. And then, the clutch arm 6 having outward teeth 26 engaging with the teeth of the first portion 75 is turned. As a result, the clutch is changed. If the operating disk 5 is turned after the clutch has been changed, the slide surface 78 of the second portion 76 is merely slided on the slide surface 73 of the operating disk 5. Therefore, the engagement between the surfaces 73,78 locks the rotation of the sector gear 74 around self axis thereof, and the clutch arm 6 cannot be moved and the clutch is fixed on the changed point.

A cam-link mechanism of the throttle operating unit is made as follows.

A roller-follower or cam-follower 42 of a link 81 is inserted in the cam groove 31 of the operating disk 5. The link 81 is a member corresponding to the rack member 35 of the device of the first embodiment. The tip end of the link 81 is connected to one of the side arms of the throttle arm 4. Accordingly, when the operating disk 5 is turned, the link 81 is vertically moved to swing the throttle arm 4.

Also in the above-mentioned embodiments, the clutch control and the throttle control can be carried out in the same manner as the first embodiment, and further, the width and height of the device can be reduced.

Though several embodiments of the invention are described above, it is to the understood that the present invention is not limited to the above-embodiments and various changes and modifications may be made in the invention without departing from the spirit and scope thereof.

The control device of the present invention has advantages that the width is small, the height of the upper part projecting from the dashboard is small, the total height of the device is also small and the control cables are not easily damaged.

What we claim is:

1. A control device for a boat engine comprising:

(a) a clutch arm, an operating disk, a throttle arm, and a single shaft for rotatably supporting said clutch arm, said operating disk and said throttle arm in that order;

(b) an operating lever extending radially and outwardly from a periphery of said operating disk for turning said operating disk;

(c) a gear mechanism installed between said operating disk and said clutch arm to change a first turn stage of said operating disk to a swing movement of said clutch arm; and (d) a cam groove formed in a side surface of said operating disk facing to said throttle arm, a rack member having a cam-follower inserted in said cam groove, and a set of teeth formed on a boss of said throttle arm and engaging with said rack to change a latter turn stage of said operating disk to a swing movement of said throttle arm.

2. The control device of claim 1, wherein said gear mechanism comprises a set of teeth formed on a side surface of said operating disk facing to said clutch arm, a pinion engaging with said teeth, and a set of teeth formed on a boss of said clutch arm and engaging with said pinion.

3. The control device of claim 1, wherein said gear mechanism comprises a tooth formed on a side surface of said operating disk facing to said clutch arm, a sector gear engaging with said tooth, and a set of teeth formed on a boss of said clutch arm and engaging with said sector gear.

* * * * *